United States Patent [19]

Bartow

[11] 4,355,703

[45] Oct. 26, 1982

[54] UPRIGHT FOR LIFT TRUCK

[75] Inventor: Richard J. Bartow, Athens, Mich.

[73] Assignee: Clark Equipment Company, Buchanan, Mich.

[21] Appl. No.: 28,292

[22] Filed: Apr. 9, 1979

Related U.S. Application Data

[63] Continuation-in-part of Ser. No. 17,779, Mar. 8, 1979, abandoned, which is a continuation-in-part of Ser. No. 842,765, Oct. 17, 1977, abandoned.

[51] Int. Cl.[3] ..... B66B 9/20

[52] U.S. Cl. ..... 187/9 E; 414/631

[58] Field of Search ..... 187/9 E, 9 R; 414/629, 414/630, 631, 641; 254/342, 389, 264, 394, 395

[56] References Cited

U.S. PATENT DOCUMENTS

| | | | |
|---|---|---|---|
| 2,855,071 | 10/1958 | Arnot | 187/9 E |
| 3,208,556 | 9/1965 | Shaffer | 187/9 E |
| 3,263,777 | 8/1966 | Robichon | 187/9 R |
| 3,289,869 | 12/1966 | Hoyt | 187/9 E |
| 3,360,078 | 12/1967 | Hopfeld | 187/9 E |
| 3,394,778 | 7/1968 | Brinton | 187/9 E |
| 3,462,028 | 8/1969 | Pi | 187/9 E |
| 3,587,784 | 6/1971 | Tait | 187/9 E |
| 3,830,342 | 8/1974 | Allen | 187/9 E |
| 3,968,859 | 7/1976 | Ehrhardt | 187/9 E |

FOREIGN PATENT DOCUMENTS

| | | | |
|---|---|---|---|
| 2020276 | 11/1971 | Fed. Rep. of Germany | 187/9 R |

*Primary Examiner*—Robert J. Spar
*Assistant Examiner*—Kenneth Noland

[57] ABSTRACT

A truck upright having a fixed upright section, one or more telescopic upright sections, and a load carrier mounted on one of the telescopic sections. A sole asymmetric lift cylinder assembly is located adjacent one side of the upright in a position which provides improved overall operator visibility through the upright. The lift cylinder is adapted to be operatively connected to a telescopic upright section by means of a pair of lifting chains. One of the chains is reeved on a pair of spaced and rotationally aligned sprockets supported either from a telescopic section or from the lift cylinder assembly such that the chain traverses the upright and is fixedly secured at one end a substantial distance outwardly of one side only of the cylinder assembly to a member, such as to the adjacent outer upright rail, and at the other end to the remote side of a telescopic section or to a fork carriage. The second chain is adapted to be reeved on a sprocket mounted from the one side of a telescopic section or from the lift cylinder ssembly, the one chain end of the second chain being also secured a substantial distance outwardly of the said one side of the lift cylinder to a member coincident with, adjacent to or in spaced relation to the corresponding end of the first chain, and the other chain end of said second chain being secured to the near or adjacent side of the telescopic section or fork carriage.

29 Claims, 12 Drawing Figures

UPRIGHT FOR LIFT TRUCK

CROSS-REFERENCE TO RELATED APPLICATIONS

This application is a continuation-in-part of copending application Ser. No. 17,779 filed Mar. 8, 1979, now abandoned, which is a continuation-in-part of application Ser. No. 842,765, filed Oct. 17, 1977, now abandoned. The present application is also related to copending application Ser. No. 202,099, filed Oct. 30, 1980, which is a continuation of said application Ser. No. 17,779. The present application is in addition related to my commonly assigned, copending applications Ser. No. 28,308 and Ser. No. 28,614, both filed on Apr. 9, 1979, and to application Ser. No. 176,742, filed Aug. 11, 1980, which is a continuation of Ser. No. 28,291, now abandoned.

BACKGROUND OF THE INVENTION

In lift trucks of the type contemplated it has been one of the most persistent problems encountered in the art over the years to provide an upright construction which both affords the operator of the truck good visibility through the upright and which is of relatively simple and low cost construction, particularly in triple and quad stage uprights. Heretofore various means have been devised for improving, or which may incidentally improve, operator visibility through telescopic uprights in lift trucks, including upright structures such as are disclosed in U.S. Pat. Nos. 2,394,458, 2,456,320, 2,855,071, 3,394,778, 3,830,342, 3,968,859, and German Pat. Nos. 1,807,169, and 2,020,276 but none have satisfied adequately the above criteria.

SUMMARY

My invention is a major step forward in the art over any prior known telescopic upright structure for lift trucks in which operator visibility through the upright and relative simplicity and low cost are of importance. In particular my invention provides an extremely novel combination of upright structure which includes an asymmetric lift cylinder assembly connected, or adapted to be operatively connected under certain conditions, to a telescopic upright section and located adjacent one side of the upright in such a manner that it projects at least partially into the area of interference by the adjacent side of the upright when in a retracted or collapsed position with the visibility of the operator from his normal line of sight through that side of the upright, and preferably projects partially also into the longitudinal plane of that side of the upright. The novel combination includes a cylinder assembly which operates a pair of flexible lifting elements (chains), one of which is reeved to traverse across the upright on a pair of rotationally aligned space sprockets (wheel elements) supported from one telescopic section or from the lift cylinder, and the other of which is reeved at one side of the upright only. Corresponding one ends of both chains are secured fixedly relatively to the lift cylinder a substantial distance outwardly of one side of the lift cylinder to a member, whereas the other end of the first chain is secured to a telescopic section or to a load carriage adjacent the opposite or remote side of the upright and the other end of the second chain is secured also to said telescopic section or load carriage adjacent the said one side of the upright to which the lift cylinder is adjacent.

It will become clear to persons skilled in the art from the detailed description which follows, that the lifting force of the asymmetric cylinder and associated sprocket and chain structure applies in a unique manner at least approximately balanced lifting force moments on the upright structure in the transverse plane of the upright while providing a visibility "window" for the operator through the upright which mounts the asymmetric cylinder and the pair of flexible lifting elements at the respective sides of the upright so as to provide improved visibility through the upright.

It is an important principle of the invention that the lifting force of the asymmetric cylinder and associated structure apply at least approximately balanced lifting force moments on the upright structure in the transverse plane of the upright.

It is a primary object of the invention to provide improved and novel upright structures for use on lift trucks and the like in which improved operator visibility is provided through the upright.

Another important object is to provide improved operator visibility in such upright structures while providing an upright of relative simplicity and low cost.

Other objects, features and advantages of the invention will readily occur to persons skilled in the art from the detailed description of the invention which follows.

DETAILED DESCRIPTION

Figure 1:
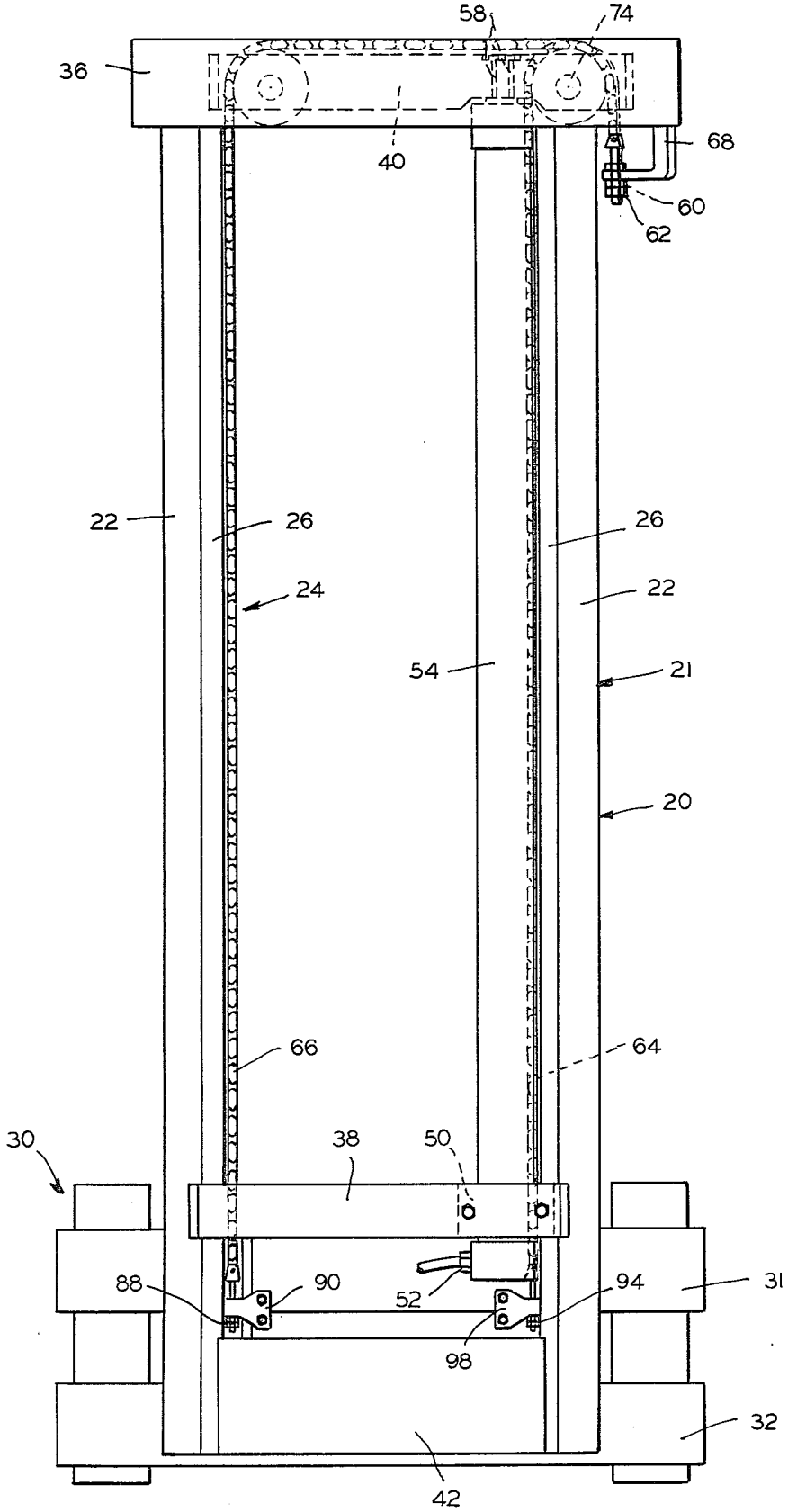
FIG. 1 is a full rear view of an upright in a retracted condition which has no free-lift.
Figure 2:
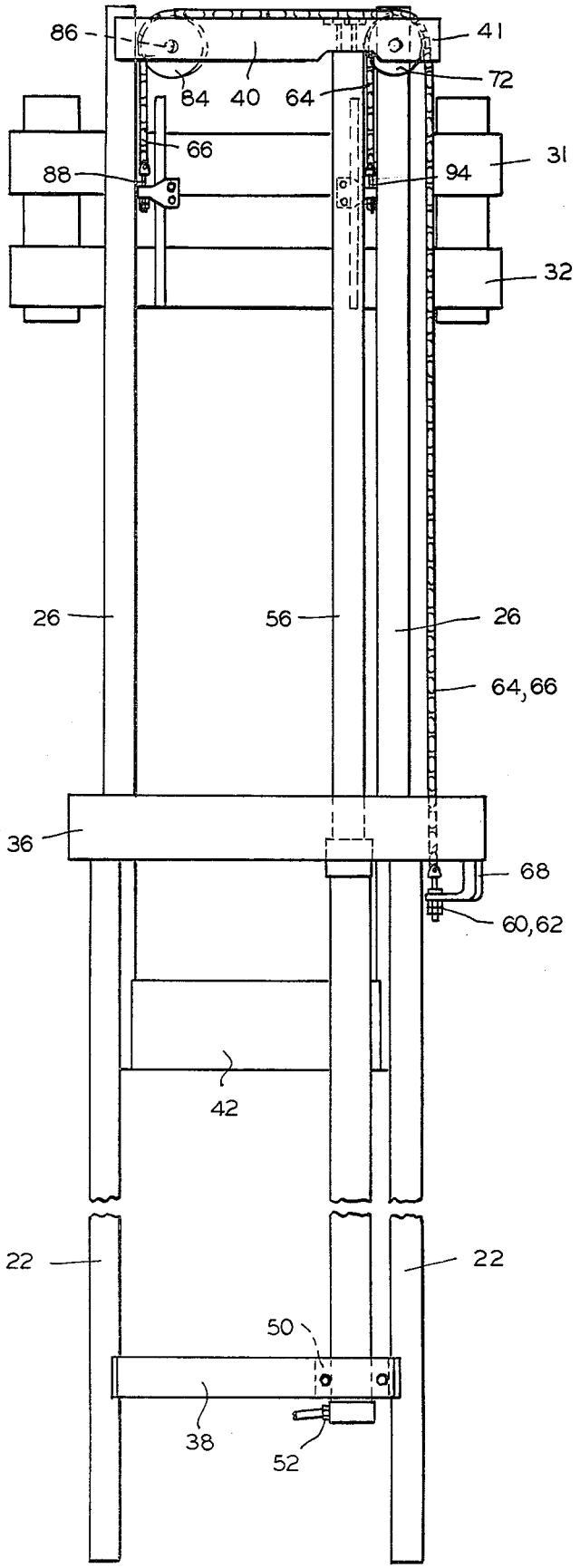
FIG. 2 is a view of the upright of FIG. 1 in an extended condition.
Figure 3:
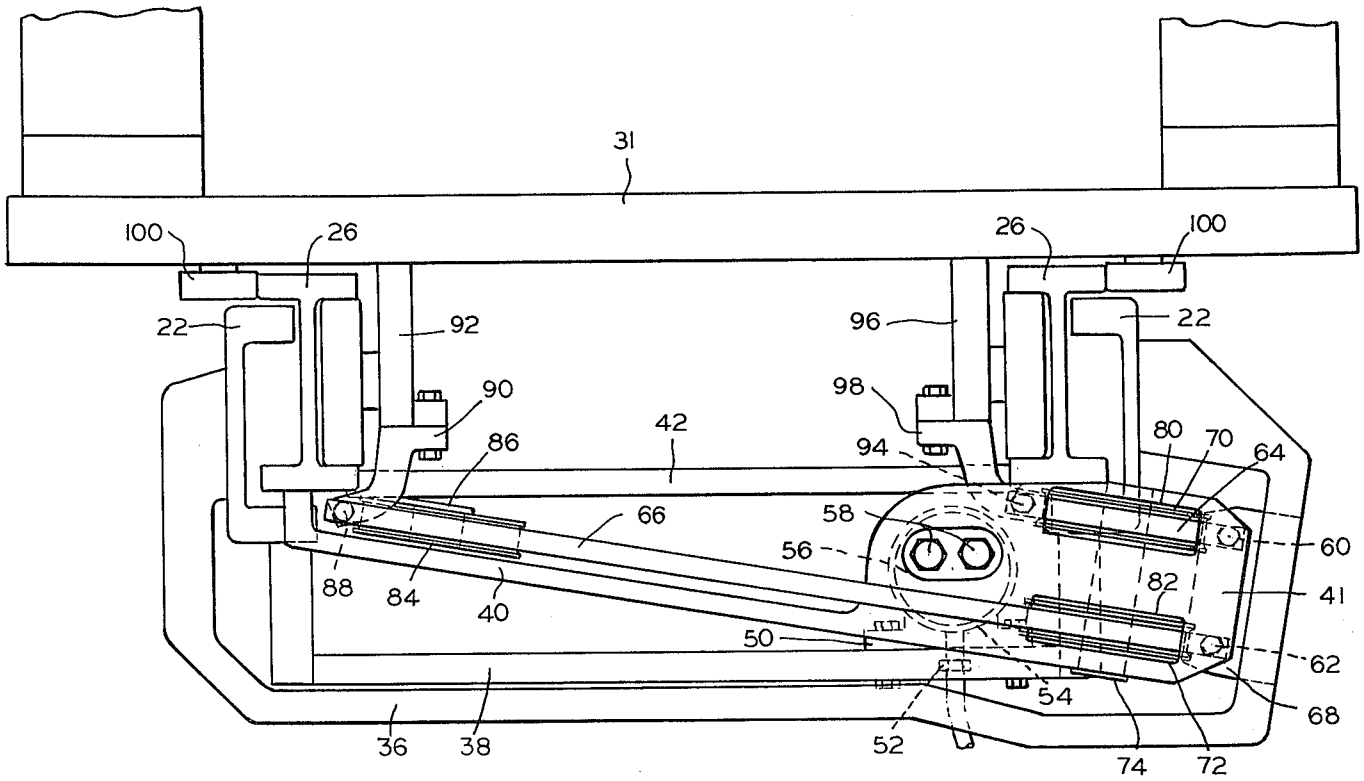
FIG. 3 is an enlarged plan view of the upright shown in FIG. 1.

Referring to the drawing, and first to FIGS. 1–3, the upright assembly of the present invention is illustrated generally at numeral 20, the assembly being mounted on a lift truck in known manner. A fixed mast section 21 includes a pair of transversely spaced opposed channel members 22 arranged to receive a single telescopic mast section 24 formed of two laterally spaced I-beams 26, mast section 24 being guide roller supported in mast section 21 in known manner by support rollers, not shown, and arranged for longitudinal movement relative thereto. A load or fork carriage 30 having a pair of transverse support plates 31 and 32 is guide roller mounted in known manner for elevation in the telescopic upright section.

Mast section 21 is cross-braced for rigidity by means of upper and lower transverse brace members 36 and 38, and telescopic section 24 is cross-braced by upper and lower transverse members 40 and 42. Member 40 has a biased configuration as shown in FIG. 3 wherein the right end includes a relatively large block member 41 secured at the upper end of the upright to the rear flange of the one rail 26 for a purpose to be described.

The I-beam mast section 24 is nested within the outer section 21 in known manner such that the forward flanges of the I-beams 26 are disposed outside of and overlapping the forward flanges of channels 22, and the rear flanges of the I-beams are disposed inside the adjacent channel portions and forwardly of the rear flanges of channels 22. Additional particulars of the nested offset I-beam upright structure, the mounting of the load carriage thereon, and the details of structure and mounting of guide and support roller pairs are explained in detail in U.S. Pat. No. 3,213,967.

As illustrated, a cylinder support block 50 is secured on brace 38 near the right hand side thereof, a hydraulic fitting 52 being mounted on the block to communicate pressure fluid to and from a cylinder 54 of a lift cylinder assembly which is mounted on the block for communication with a lift truck hydraulic system, not shown. An extensible piston rod 56 is connected to mast section 24 at the upper end by a pair of bolts 58 which secure the piston rod end to a portion of block member 41. A pair of chain anchors 60 and 62 are spaced longitudinally of the truck on a bias, as shown. The anchors secure the outer ends of a pair of lifting chains 64 and 66 to a bracket 68 which is secured to member 36. A pair of complementary spaced sprockets 70 and 72 are mounted on a bias, as shown, for rotation on a biased shaft 74 which is mounted in an opening extending through block member 41, elongated vertical openings 80 and 82 being formed in member 41 for receiving the shaft and the sprockets. A third sprocket 84 is mounted at the opposite side of the upright for rotation on a stub shaft 86 which is secured to the forward surface of biased brace 40. Sprockets 82 and 84 are mounted in the upright in substantial longitudinal rotating alignment to each other, chain 66 extending from the one anchor 62 over sprockets 82 and 84 to securement at a remote second anchor 88 on an anchor bracket 90 which is secured to the one fork carriage support bar 92. Chain 64 is reeved on the single sprocket 70 from anchor 60 to a second anchor 94 which is located on the same side of the upright as the lift cylinder, anchor 94 being connected to the other fork carriage support bar 96 by an anchor bracket 98. Conveniently, as above described, the sprockets are mounted from brace 40 and end block 41 thereof on a bias in relation to the upright, but can, of course, be mounted if desired in true transverse relation to the upright adjacent the rear ends of the rails thereof, or adjacent the forward or fork side of the upright, both of which general modifications are illustrated in respect of the single lifting chain construction in FIGS. 5 and 6 of my above copending application Ser. No. 202,099, filed Oct. 30, 1980. Of course, the structure would be modified to provide for the dual chain and multiple sprocket structure of the present invention, as applied to opposite sides of the load carriage 30, but basic structural modifications may be as in said prior application, as will be readily recognized by persons skilled in the art.

In order to substantially balance the force moments acting in a transverse plane on the embodiment of the upright assembly as disclosed in FIGS. 1–3, the connections of chains 64 and 66 to anchors 88 and 94 should be approximately equally spaced on opposite sides of the transverse center of load carriage 30, and the location of the connection of the piston rod 56 to brace 40 of telescopic section 24 should be at or near one-quarter of the sum of the projected or transverse distances from the transverse center or central vertical plane of load carriage 30 to the two chain anchors 60 and 62. It should be noted that the relative locations and spacing either longitudinally or transversely of the upright of anchors 60 and 62 may be varied to suit design requirements so long as the above distance relationship between the connection of the piston rod to the telescopic section and the sum of the said transverse distances is maintained, whereby considerable design flexibility is possible in this respect.

In such a design the forces passing through upright sections 21 and 24 create substantially no unbalanced moments or a calculated small unbalanced moment in the transverse plane of the upright. In an ideal design the upright functions in theoretical force moment balance, but such theoretical conditions do not ordinarily exist in practice, and side thrust or torque loading on the upright such as result from unbalanced moments effected by off-center loads on the fork, for example, may be resisted by upper and lower pairs of load carriage side thrust rollers 100 operating on the outer flange edges of I-beams 26 in known manner.

It should be noted that the weight of the inner upright section 24 will impart a slight unbalanced moment in a counterclockwise direction, as seen in FIGS. 1 and 2 on the asymmetric cylinder assembly 54,56, so that if desired the latter unbalanced moment may be compensated by adjusting the location of the cylinder assembly slightly inwardly of its force balance position between the projected chain anchor locations. On the other hand any such inward adjustment of the cylinder assembly location may interfere somewhat with maximum visibility through that side of the upright, depending upon the operator's normal line of sight through that side of the upright. Also, any such unbalanced force moments are relatively minor and will be, in most uprights, readily acceptable in the overall design.

The designer of uprights of various widths, depths, seat locations, and the like may choose any one of a number of viable combinations of such structure within the scope of my invention. It should therefore be understood that recitations in the claims hereof relating to the substantial or approximate balance of force moments in the upright, or to the asymmetric position of the cylinder, shall be interpreted to include a range of positions of the cylinder assembly between the sprockets which best effects the desired result of good operator visibility through the upright and adequately balanced force moments in the transverse plane of the upright acting on the upright in operation.

The design is such that the location of the cylinder assembly at one side of the upright combines with the location of the operator, preferably offset a predetermined distance to the opposite side of the longitudinal axis of the truck (FIG. 4), to provide an operator's line of sight through the upright on the side at which the cylinder assembly is located so that the cylinder assembly interferes a relatively small amount, or even not at all in some multi-stage embodiments, with the operator's visibility through that side of the upright. In other words, the cylinder assembly projects at least partially into the area of interference by the adjacent side of the upright when in a retracted or collapsed position with the visibility of the operator from his normal line of sight through that side of the upright, as may be seen in FIG. 4 in the "worst case" embodiment of FIGS. 4–8 hereof to be described below.

The principles of upright design and force moment balancing as described hereinabove may be applied to many and various types and designs of multiple stage uprights, including, without limitation, standard free-lift and triple stage uprights as described later herein.

References made in the specification and claims hereof to the longitudinal and/or transverse planes of one side of the upright, or of the vertical rails of the upright, or terms of similar import, shall have the following meanings.

The longitudinal plane of the one side of the upright shall mean a vertical plane extending longitudinally of the upright assembly bounded by the outer and inner surfaces of the vertical rail assembly on one side of the upright, while the transverse plane of the upright or of the one side thereof shall mean a vertical plane extending transversely of the upright assembly bounded by the front and rear surfaces of the vertical rail assembly of the upright.

In the operation of the embodiment of FIGS. 1–3 pressurized fluid is conducted to or exhausted from the single-acting lift cylinder assembly 54,56 which effects a simultaneous elevation or lowering, as the case may be, of fork carriage 30 in telescopic upright section 24, and of the latter upright section in fixed section 21 without free-lift of the load carriage in relation to upright section 24 during elevation. The load carriage is elevated at a 2:1 ratio in relation to section 24 from the position shown in FIG. 1 to that shown in FIG. 2, section 24 being elevated with the piston rod in relation to outer section 21.

Referring now to the modified two-stage upright assembly of FIGS. 4–8, major similar parts have been numbered the same as in FIGS. 1–3. The major design modification involves the provision for a relatively small free-lift of the load carriage from the ground level position shown in FIG. 5 to the slightly elevated position of FIG. 6 while the telescopic section remains in a collapsed position. Otherwise, the upright design is essentially the same as shown in the previous embodiment.

Figure 5:
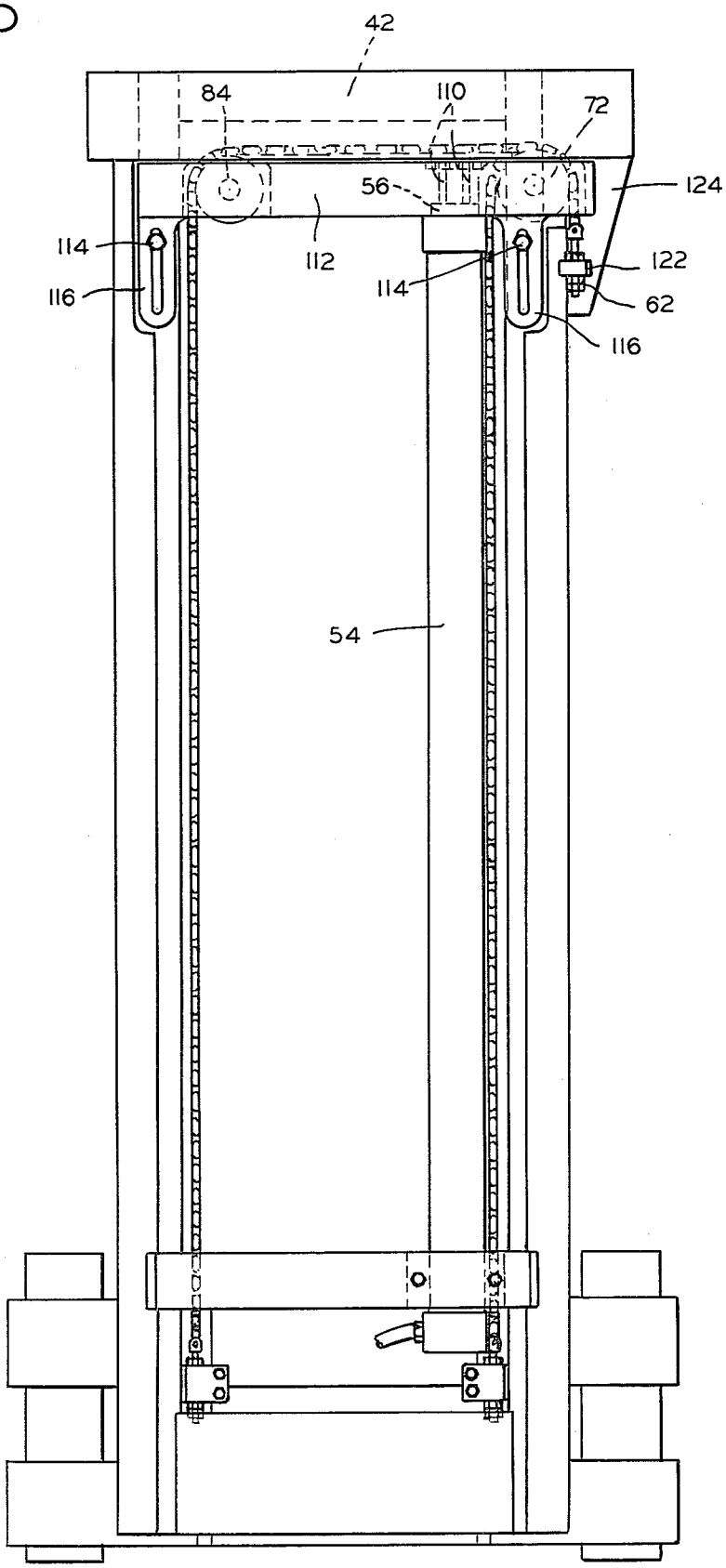
FIG. 5 is a rear view of a modified upright structure having limited free-lift, shown in a retracted position.
Figure 6:
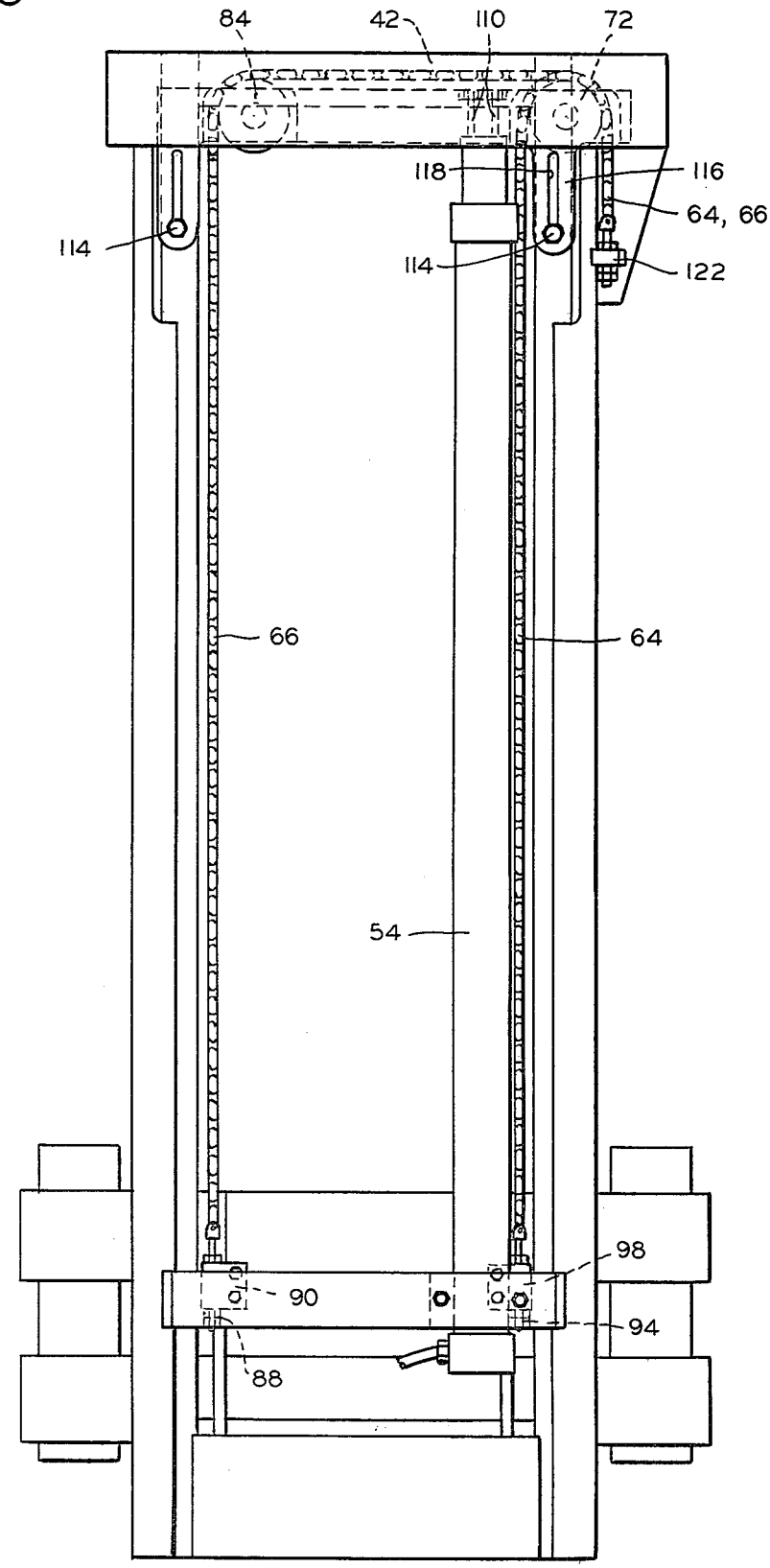
FIG. 6 illustrates the upright of FIG. 5 in a position of free-lift.
Figure 8:
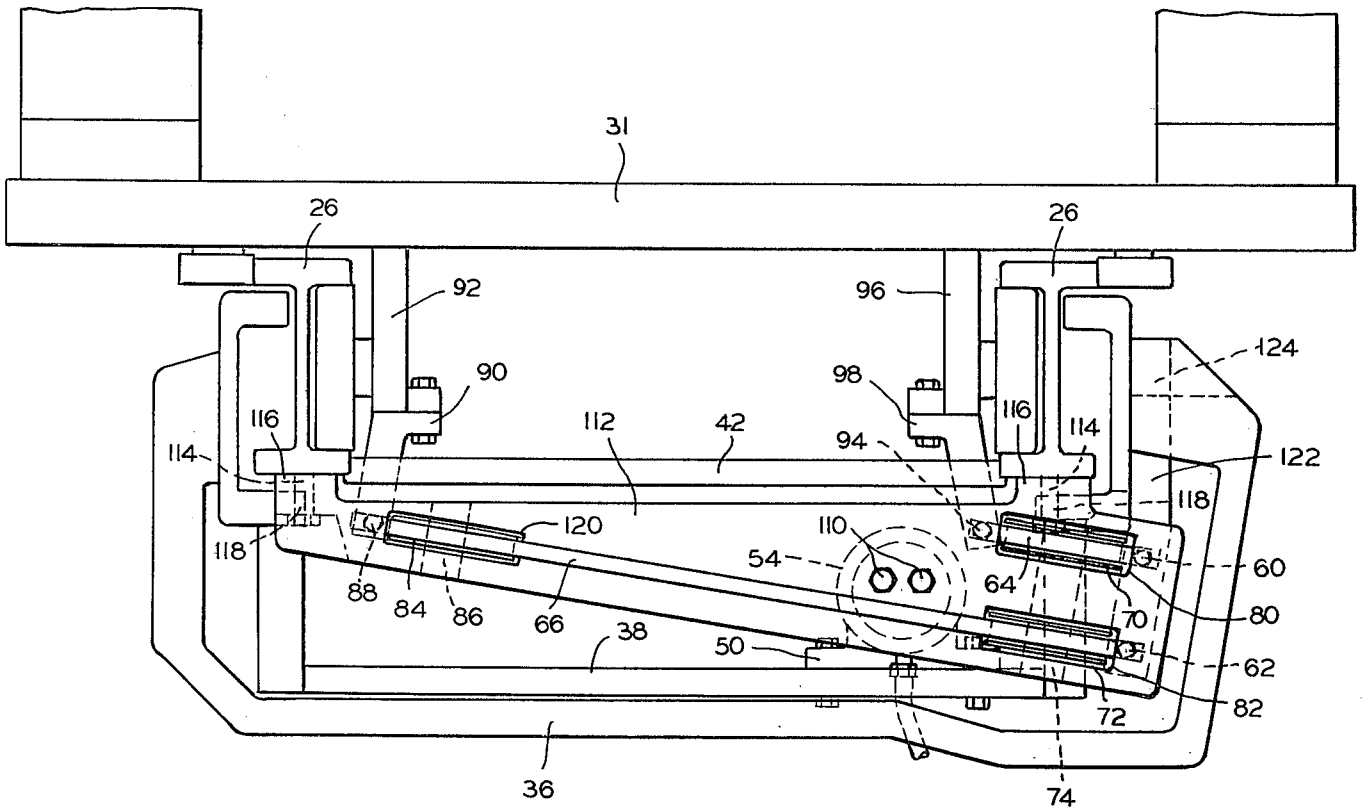
FIG. 8 is an enlarged plan view of the modified upright of FIG. 5.

The cylinder assembly 54,56 is mounted rigidly from the base at 50 on brace 38 and, in an upright of the same collapsed height as in FIGS. 1–3, is of shorter length herein so as to enable load carriage 30 to be actuated in the upright to a free-lift position, as shown in FIG. 6, as piston rod 56 extends from the position in FIG. 5 to that in FIG. 6. To accomplish this operation there is mounted rigidly atop the piston rod by a pair of bolts 110 a generally triangular shaped brace member 112 (as seen in FIG. 8) which is connected to each of the rails 26 of the telescopic section by a guide bolt 114 secured to and at a predetermined distance below the upper end of the rear flange of each I-beam rail. Bolts 114 extend rearwardly of the respective rails for connection with a downwardly depending end portion 116 at each side of brace 112 in a vertical slot 118 thereof. Sprockets 70,72 and 84 are mounted on biased shafts 74 and 86 as in the first embodiment, sprockets 70 and 72 being mounted for rotation in slots 80 and 82 of the base end of the triangular brace 112 as before, and sprocket 82 being mounted in a slot 120 formed in the apex end of the brace member 112. Chain anchor members 60 and 62 secure the outer ends of the pair of chains 64 and 66 to rearwardly extending chain anchor support 122 which is secured, as by welding, to a downwardly depending member 124 at the right forward corner portion of brace 36. The opposite end of chain 66 is secured at anchor 88 to bracket 90, while the opposite end of chain 64 is secured to anchor 94 to bracket 98 as previously.

Figure 7:
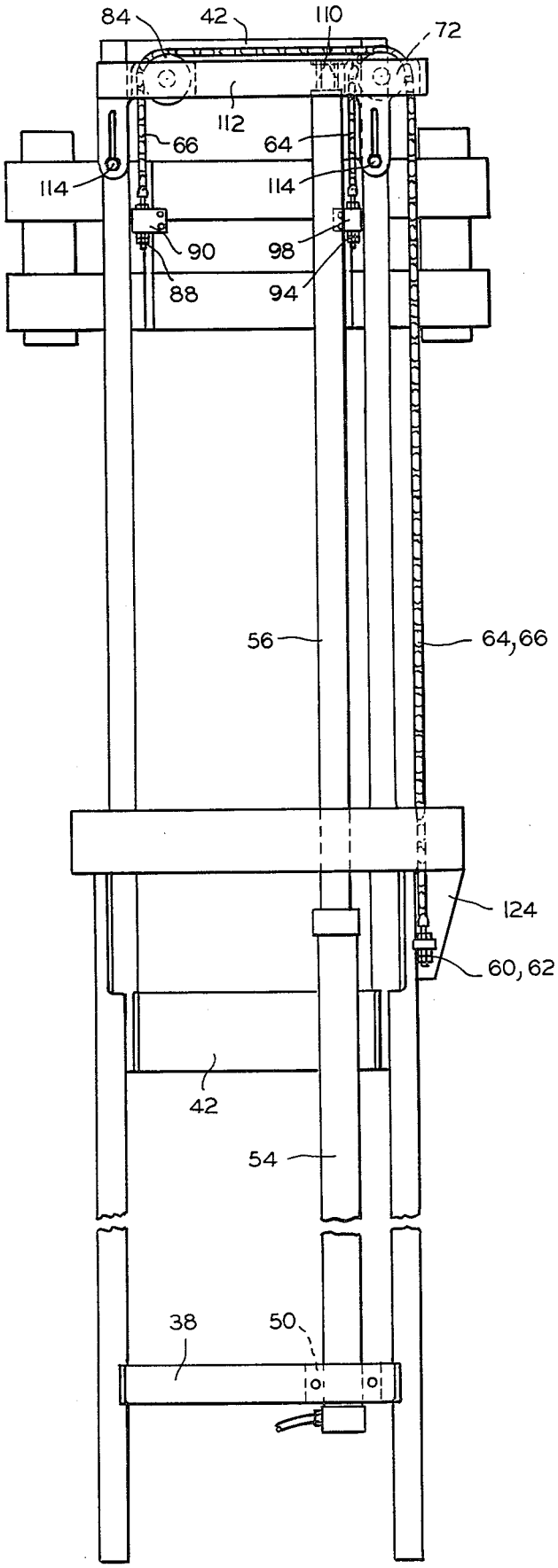
FIG. 7 shows the modified upright structure at full elevation.

The operation is similar to that of FIGS. 1–3 except that the initial stage of elevation of the piston rod 56 effects an elevation of support member 112 from the FIG. 5 to the FIG. 6 position as member 112 with sprockets 70,72 and 84 elevate the carriage in free-lift until guide and load support bolts 114 contact the lower ends of slots 118, at which time further extension of the piston rod elevates the telescopic section to maximum elevation as shown in FIG. 7 while the fork carriage is elevated by chains 64 and 66 to the FIG. 7 position at a 2:1 speed ratio as usual.

Figure 4:
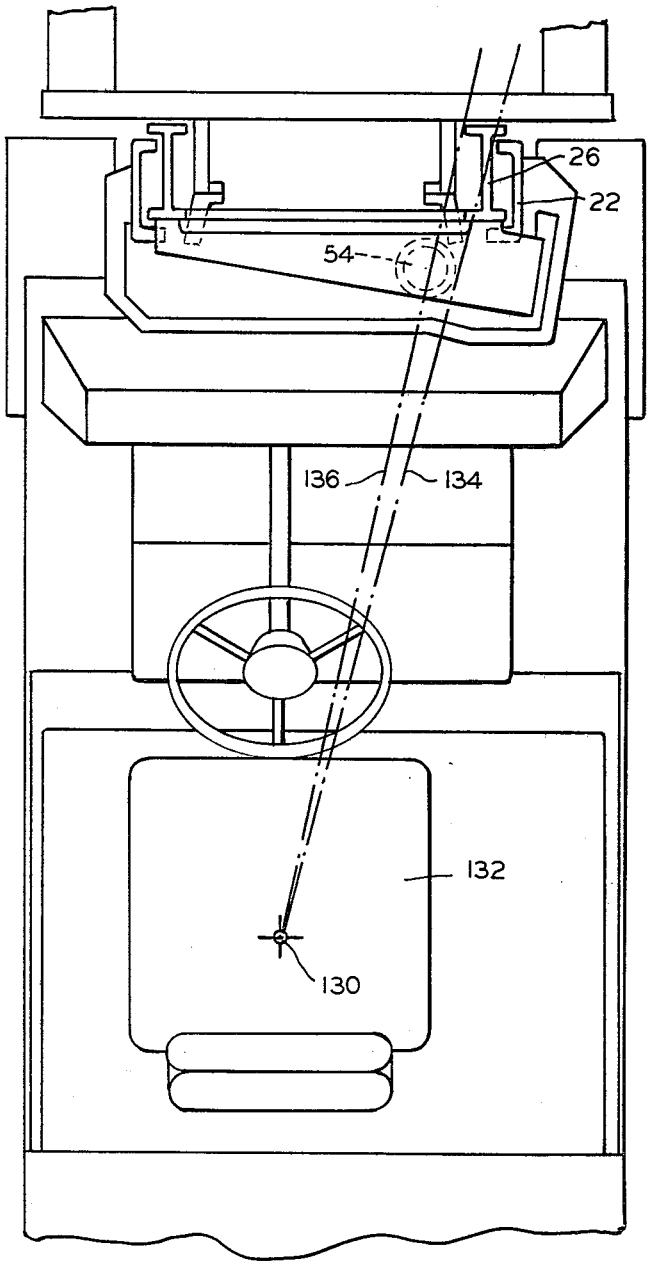
FIG. 4 is a schematic plan view of a lift truck showing the location of the area of overlap between the lift cylinder and one side of the upright of FIGS. 5–8 in relation to the normal line of sight of the operator through that side of the upright.

FIG. 4 represents an outline in plan view of a lift truck having the upright of FIGS. 5–8 showing a design location of operator's normal line of sight from a source 130 at the center of an operator seat 132 through the right hand side of the upright. Line-of-sight lines 134 and 136 are projected from source 130 to be tangent, respectively, to the right side of cylinder 54 and to the left inside corner of the forward flange of rail 26, as shown, thereby identifying the portion of the cylinder assembly which projects into the above-described area of interference by the adjacent side of the upright when in a retracted position with the visibility of the operator from his normal line of sight through that side of the upright. Of course, the greater the portion of cylinder projection into the area of such interference the greater is operator visibility through the upright. Of my various upright designs utilizing my invention. FIG. 4 represents the "worst case" embodiment, as mentioned previously, in that a relatively small area of such interference is provided in the FIGS. 5–8 embodiment. Other designs contemplated include such an area of interference which may be at least equal to the radius of the cylinder, or in the case of the triple stage upright to be described below, is equal to an area of interference substantially equivalent to the diameter of the cylinder so that the lift cylinder interferes little or not at all with operator visibility through the upright.

Referring now to the triple stage embodiment of FIGS. 9–12, a fixed mast section 150 includes a pair of transversely spaced opposed channel members 152 arranged to receive an intermediate telescopic mast section 154 formed of two laterally spaced I-beams 156, mast section 154 being guide roller supported by rollers, not shown, in mast section 150 and arranged for longitudinal movement relative thereto. An inner mast section 158 formed of two laterally spaced I-beams 160 is similarly guide roller supported in mast section 154 and arranged for longitudinal movement relative thereto. A load or fork carriage 162 having a pair of longitudinal support plates 164 and 166 is guide roller mounted for elevation in the inner upright section 158, all in known manner.

Mast section 150 is cross-braced for rigidity by means of upper and lower transverse brace members 168 and 170, intermediate telescopic section 154 is cross-braced by upper and lower transverse members 172 and 174, and inner section 158 is cross-braced by upper, intermediate and lower transverse members 176, 178 and 180, members 178 and 180 also serving to support the primary lift cylinder, as will be explained.

Particulars of the triple-stage nested offset I-beam upright structure, the mounting of the load carriage thereon, and the details of structure and mounting of guide and support roller pairs are explained in detail in my above copending application and in U.S. Pat. No. 3,213,967.

Figure 10:
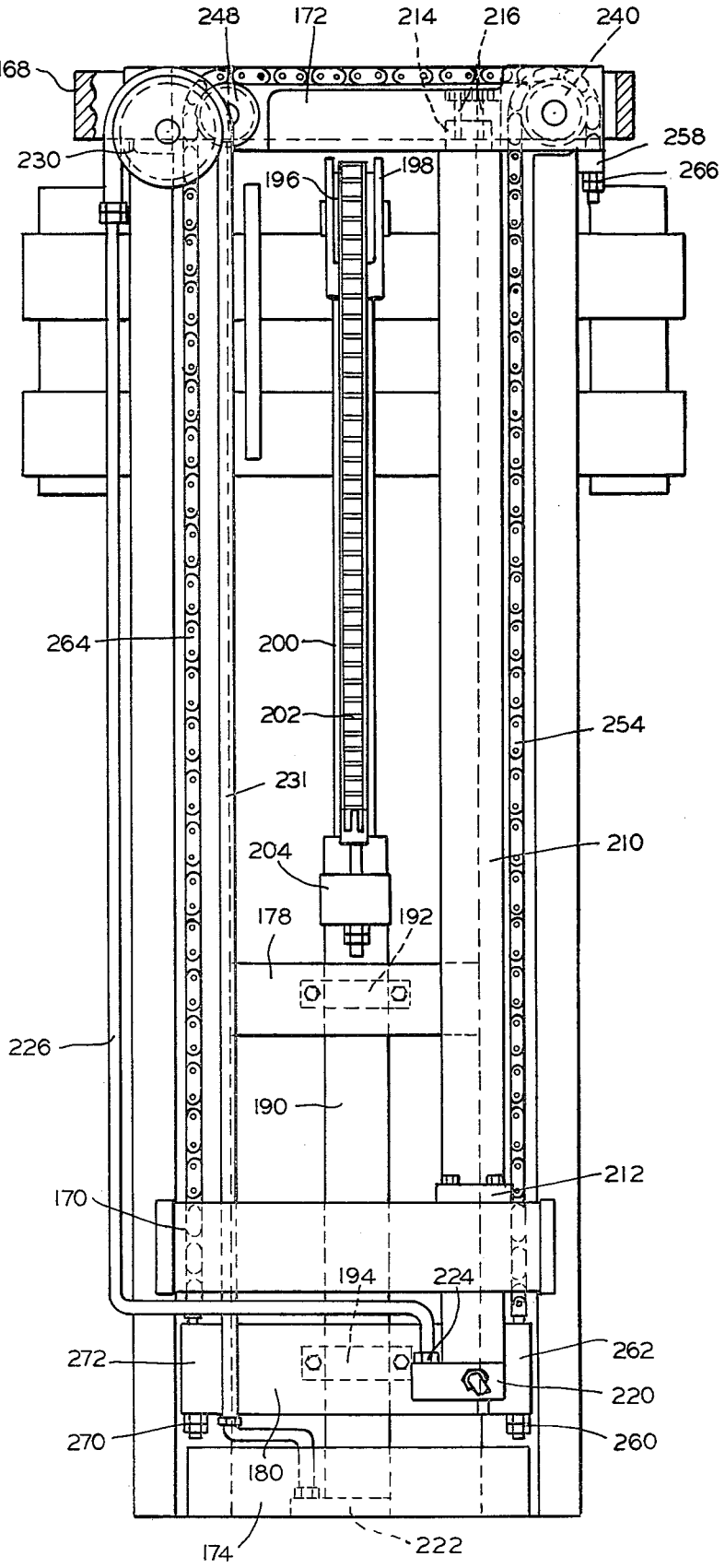
FIG. 10 is a full rear view of the upright of FIG. 9 in a full free-lift position.

A primary cantilevered lift cylinder assembly 190 is supported centrally of inner upright section 158 on brace members 178 and 180 by brackets 192 and 194 secured, as by welding, to the cylinder and secured by studs to the brace members. A single sprocket 196 is mounted for rotation by a bracket 198 at the end of a piston rod 200, a lifting chain 202 being reeved on the sprocket and secured at one end to an anchor plate 204 located on the cylinder, and at the opposite end secured centrally of a carriage plate 206 by an anchor block 208 (FIG. 12). The hydraulic lift cylinder assembly 190,200 is substantially one-half the length of the inner upright section and when extended actuates the fork carriage at a 2:1 ratio to a full free-lift position as shown in FIG. 10 prior to the elevation of intermediate and inner upright sections 154 and 158 by a secondary asymmetric hydraulic lift cylinder assembly 210, shown in a position of partial extension in FIG. 11.

The cylinder 210 is supported near the bottom from brace member 170 by a collar 212 welded to the cylinder and bolted to the top edge of the brace member, as shown, the piston rod 214 being secured by a pair of studs 216 to brace member 172, thus supporting the cylinder assembly 210,214 from the top and the bottom. Member 172 has an elongated generally triangular configuration similar to brace and support member 112 in FIGS. 5–8, and for the same purpose. A junction block 220 is located at the bottom of the cylinder for conveying pressure fluid to and from the cylinder 210 from a hydraulic system, not shown, it being also connected to a junction block 222 of the primary cylinder by a fitting 224 in block 220, non-flexible conduits 226 and 228, and a flexible conduit 231 which connects conduits 226 and 228 and which is reeved on a sheave 230 mounted for rotation on a stub shaft 232 which is supported from brace member 172. The sheave and conduit assembly are mounted in an inverted U-shaped position substantially behind the upright rails on the side opposite cylinder 210 so that interference thereof with visibility of the operator is minimized, as will be observed.

The structure and mounting of the dual chains and sprockets of this embodiment is similar to that of the embodiment of FIGS. 5–8. It includes a single double-wide sprocket 240 mounted for rotation on a shaft 244 in a slot or opening 246 of sprocket support and brace member 172, a second transversely spaced and rotationally aligned sprocket 248 being mounted in a recess 250 of brace 172 on a stub shaft 252 at the opposte side of the upright. A first chain 254 is secured at anchor 256 to an anchor block 258 secured to the side of fixed rail 152 and reeved on the one side of sprocket 240. The chain extends down through opening 246 and is connected at its opposite end by anchor 260 to a bracket 262 which is bolted to brace 180. The second chain 264 is secured by an adjacent anchor 266 to anchor block 258 and is reeved as shown on the other side of sprocket 240 and on sprocket 248, thence downwardly at the opposite side of the upright to an anchor 270 secured by bracket 272 to brace 180.

The force moments acting on the upright assembly are, of course, balanced in respect of the operation of centered primary cylinder 190,200 and in respect of the operation of asymmetric cylinder 210,214 operating between the sprockets in a structure similar to that described in the preceding embodiments. The forces passing through the respective upright sections create substantially no unbalanced moments, or create a calculated unbalanced moment in the transverse plane of the upright in a manner similar to that described in detail above in respect of the two-stage uprights.

The structure and operation of the triple stage upright as disclosed will now be apparent, particularly when taken in conjunction with the more detailed description of the principles of my invention described above in connection with the two-stage uprights. I have found that in order to achieve most desirable results in terms of operation visibility, that cylinder 210 should be located such that it projects a distance into the previously discussed area of interference with operator visibility by the adjacent side of the retracted upright which is at least equal to or substantially greater than, the radius of the cylinder, and which also projects at least partially into the longitudinal plane of the adjacent side of the upright.

Figure 9:
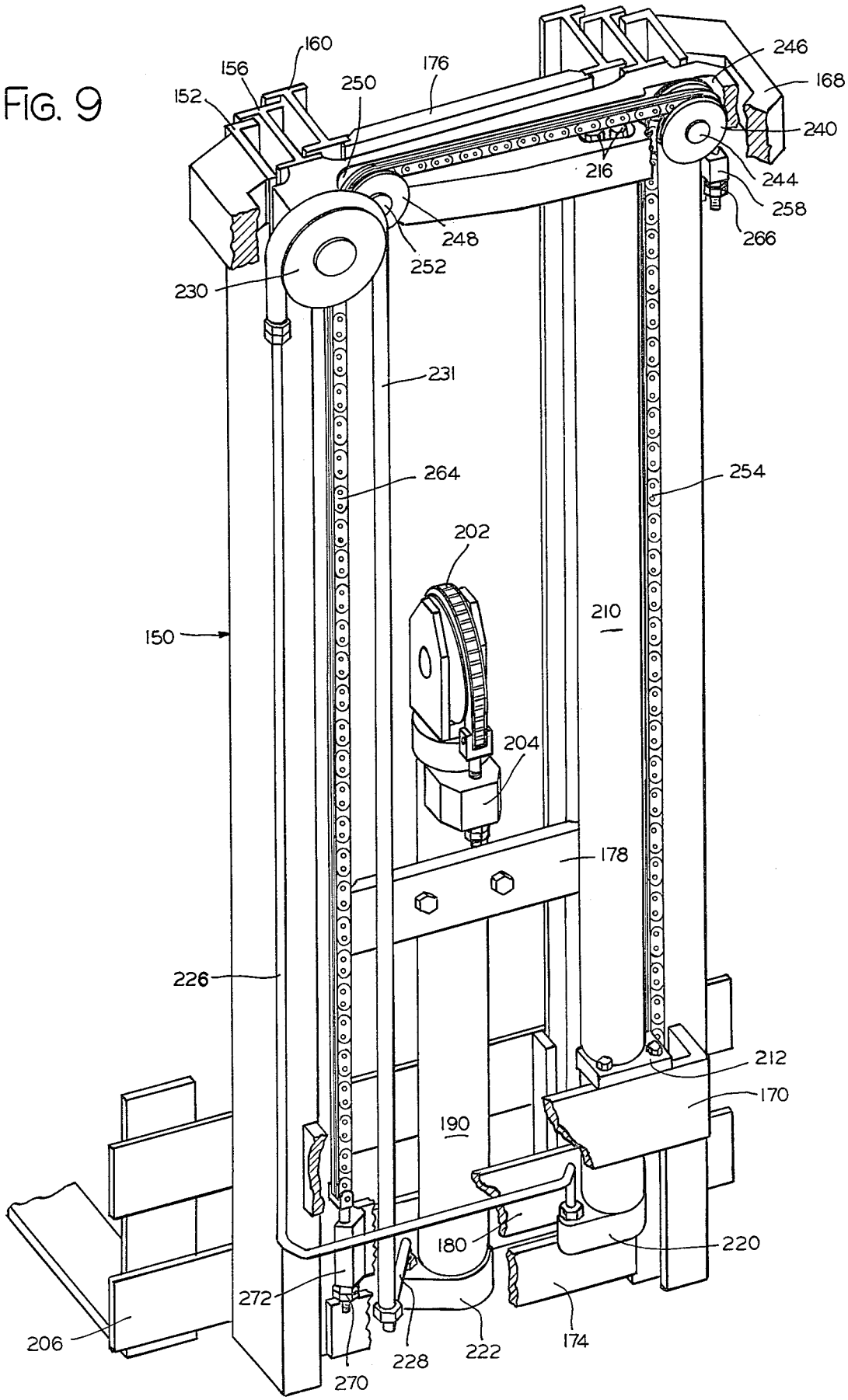
FIG. 9 is a perspective view of a triple stage upright shown in a retracted condition.
Figure 11:
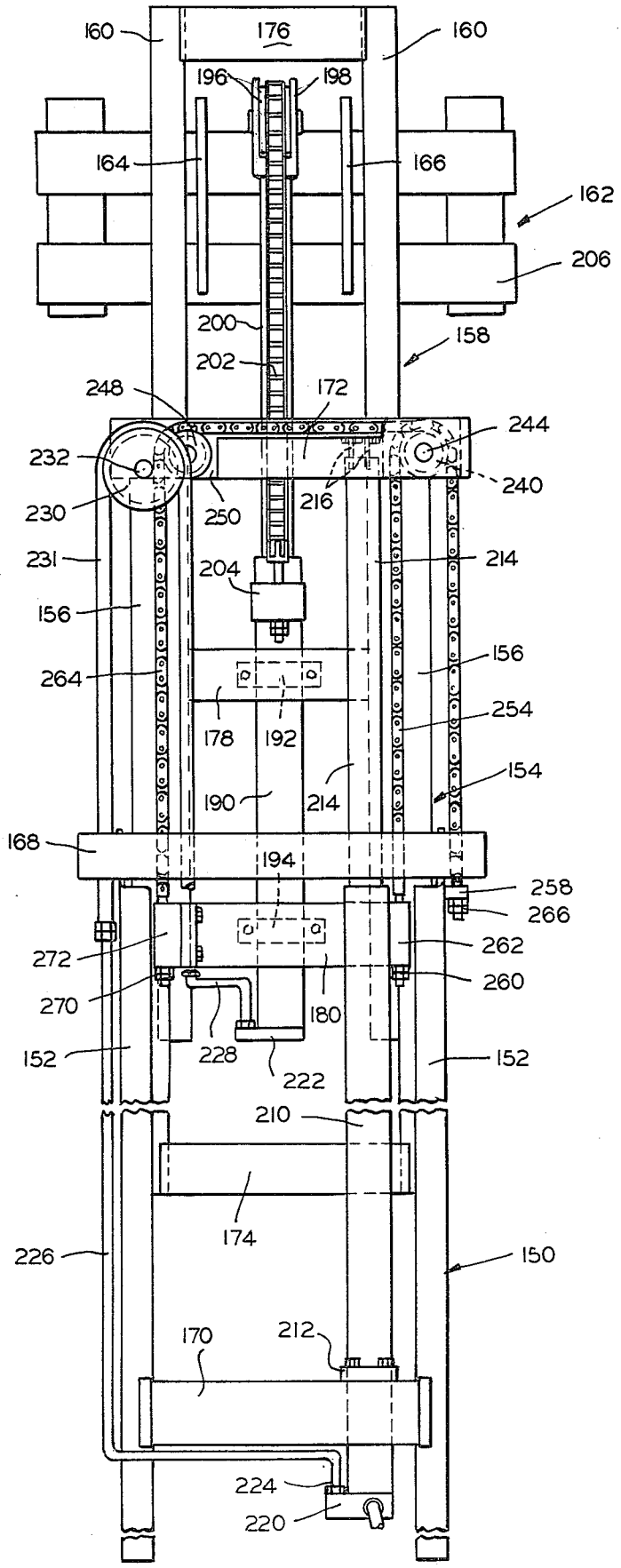
FIG. 11 is a rear view of the triple stage upright in a condition of partial elevation of the telescopic sections.
Figure 12:
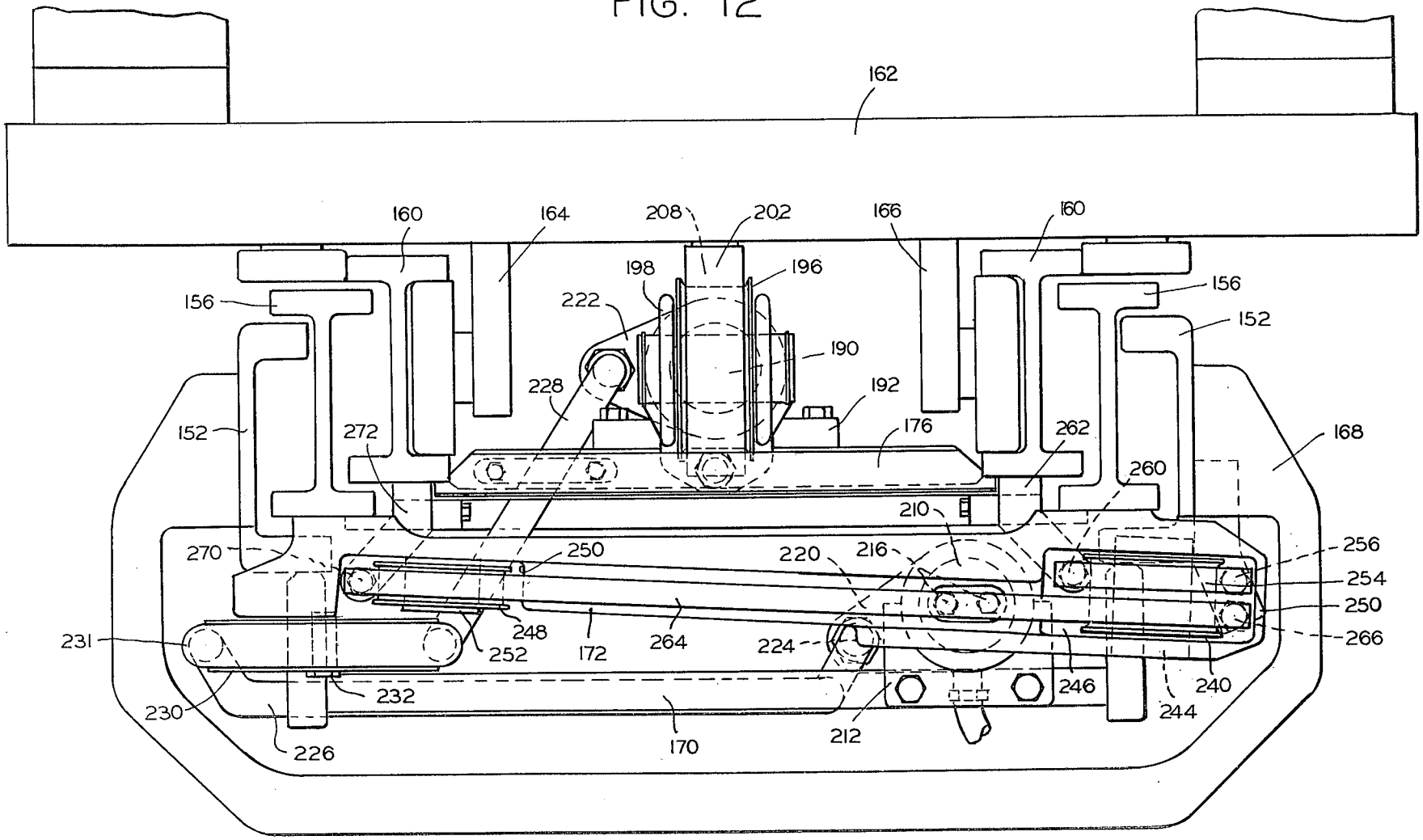
FIG. 12 is a plan view of the triple stage upright.

In operation, to elevate the upright from the position in FIG. 9 to that in FIG. 11, for example, pressure fluid is delivered by the hydraulic system simultaneously to cylinder assemblies 190 and 210 and, as is knwon, the cylinders operate automatically in a sequence related to the loads supported thereby, whereby cylinder 190 functions initially to elevate load carriage 162 in inner upright section 158 to the full free-lift position illustrated in FIG. 10 at a 2:1 ratio to the movement of piston rod 200. At the termination of this initial stage of operation the pressure fluid automatically sequences asymmetric cylinder 210 to elevate the entire telescopic upright structure in outer section 150 while the load carriage is maintained by primary cylinder 190 in the aforementioned full free-lift position; i.e., the direct connection of cylinder assembly 210 to telescopic section 154 effects an elevation thereof in section 150, as shwn in partial elevation in FIG. 11, and simultaneously effects through the unique reeving and connections of chains 254 and 264 to inner upright section 158 an elevation thereof at a 2:1 movement ratio relative to section 154 to the position shown in FIG. 11, and thence to a position maximum elevation if the operator maintains the supply of pressure fluid from the hydraulic system. Lowering of the upright is effected by venting the cylinders to the fluid reservoir, whereby a reversal of the above-mentioned sequencing occurs as cylinder assembly 210 first fully retracts to the position of FIG. 10, subsequent to which cylinder 190 retracts the load carrier to the FIG. 9 position.

It will be understood by persons skilled in the art that many other design variations in the upright designs that those identified and described previously may be found feasible without departing from the scope of my invention.

For example, although the basic design of the uprights as disclosed in all embodiments herein is of the offset I-beam roller mounted type, which is preferred, it will be appreciated that the invention may be also used with many other known upright designs, including coplanar (not offset) roller mounted channels or I-beams, fully nested roller mounted I-beams inside of outer channels, non-roller mounted sliding inner channel in outer channel, a telescopic upright section mounted outwardly of an inner mounted fixed upright section, and the like.

The location of the fixed chain anchors 60,62 and 256,266 in the various embodiments hereof may, of course, be varied in different upright designs as desired, such as at different selected vertical locations on the outer rail, or located on an outwardly extending cantilevered anchor support which may be secured to the asymmetric cylinder, or in the case of an upright mounted from certain types of lift trucks without provision for fore and aft tilting thereof the anchor can be located on the truck frame. In the latter design it may be feasible, of course, to mount the bottom of the asymmetric cylinder assembly also from the truck frame instead of directly from the bottom of the fixed upright section.

Depending upon such things as the axial distance of the operator from the upright, the width of the upright, or the transvere position of the operator when seated or standing in a normal operating position on different lift truck types, the most desirable precise location of the asymmetric cylinder assembly based upon the various factors will be established, some of the major ones of which are discussed above. As noted previously the most critical combination of factors affecting the selection of a cylinder location is operator visibility and force moment balance on the upright, both of which may be compromised from the ideal within the scope of my invention as required to effect the most desirable combination. In this connection it will be understood that the asymmetric cylinder assembly may in different sizes and designs of uprights desirably project partially into both the longitudinal and transverse planes of the one side of the upright, such as is shown in FIG. 3.

In a relatively wide upright, for example, and with the operator located relatively close to the upright in a forward direction and well off-center to the left thereof, it may be found advantageous to locate the cylinder further forwardly necessitating a relocation thereof leftwardly and out of the longitudinal plane of the right side of the upright, in which event the cylinder may or may not project partially into only the transverse plane of the upright without interfering unduly with operator visibility through the upright. On the other hand, it may be found under certain design conditions that the cylinder may be located further rearwardly so as to project into the longitudinal plane only, partially or even wholly of the one side of the upright, and not project at all into the transverse plane thereof. Again, it may be found desirable that the cylinder project into neither such plane, all within the scope of my invention.

However, before the particulars of any given upright design are finalized, it is important that in any multi-section upright using this invention, whether of two, three, or more stages, and regardless of other available numerous design variations such as are described herein, the asymmetric cylinder assembly should be located such that it projects at least partially into an area of interference by the adjacent side of the upright when in a retracted or collapsed position with the visibility of the operator from his normal line of sight through that side of the upright.

Although I have illustrated only certain embodiments of my invention, it will be understood by those skilled in the art that many modifications, such as are discussed above, may be made in the structure, form, and relative arrangement of parts without departing from the spirit and scope of the invention. Accordingly, I intend to cover by the appended claims all such modifications which properly fall within the scope of my invention.

I claim:

1. In an upright structure for lift trucks and the like having one upright section including transversely spaced vertical rails, a telescopic upright section including transversely spaced vertical rails mounted for elevation relative to said one section and elevatable load carrier means mounted for elevation relative to said telescopic section, the improvement comprising a sole asymmetric lift cylinder assembly mounted in the upright structure which is operatively connected to said telescopic upright section, first and second flexible lifting elements reeved on first and second wheel elements and operatively connected to said cylinder assembly, to said one upright section and to said load carrier means, one end of each flexible lifting element being secured a substantial distance outwardly of one side only of the cylinder assembly, the other end of the first flexible lifting element being secured to said load carrier means adjacent the adjacent side of the upright and the other end of the second flexible lifting element being secured to said load carrier means adjacent the opposite side of the upright, said cylinder assembly together with said first and second flexible lifting elements being adapted to elevate said load carrier means relative to the telescopic upright section and the latter section relative to the one upright section, the lift cylinder being located substantially at one side of the upright structure such that it projects at least partially into the area of interference by an adjacent vertical rail with the visibility of the operator from his normal line of sight through said adjacent vertical rail.

2. In an upright structure for lift trucks and the like having one upright section including transversely spaced vertical rails, a first telescopic upright section including transversely spaced vertical rails mounted for elevation relative to said one section, a second telescopic upright section including transversely spaced vertical rails mounted for elevation relative to said first telescopic upright section, and a load carrier means mounted for elevation relative to said second telescopic upright section, the improvement comprising a sole asymmetric lift cylinder assembly mounted in the upright structure which is operatively connected to said first telescopic upright section, first and second flexible lifting elements reeved on first and second wheel elements and operatively connected to said cylinder assembly, to said one upright section and to said second telescopic section, one end of each flexible lifting element being secured a substantial distance outwardly of one side only of the cylinder assembly, the other end of the first flexible lifting element being secured to said second telescopic section adjacent the adjacent side of the upright and the other end of the second flexible lifting element being secured to said second telescopic section adjacent the opposite side of the upright, said cylinder assembly together with said first and second flexible lifting elements being adapted to elevate said second telescopic section relative to the first telescopic upright section and the latter section relative to the one upright section, the lift cylinder being located substantially at one side of the upright structure such that it projects at least partially into the area of interference by an adjacent vertical rail with the visibility of the operator from his normal line of sight through said adjacent vertical rail.

3. An upright structure as claimed in claims 1 or 2 wherein said cylinder assembly is mounted at least partially rearwardly of the adjacent vertical rail assembly and projects at least partially into the transverse plane thereof.

4. An upright structure as claimed in claims 1 or 2 wherein the location of said lift cylinder is such that it projects substantially into said area of interference by an adjacent vertical rail.

5. An upright structure as claimed in claims 1 or 2 wherein the location of said lift cylinder is such that it projects a distance into said area of interference by an adjacent vertical rail which is at least equal to the radius of the cylinder.

6. An upright structure as claimed in claim 1 or 2 wherein said cylinder assembly is supported primarily from the vertical rail of one side of said one upright section.

7. An upright structure as claimed in claim 2 wherein a second lift cylinder assembly is adapted to elevate said load carrier means relative to said second telescopic section, and conduit means connecting hydraulically the base ends of the asymmetric and second lift cylinder assemblies, said conduit means being supported from the upper end portion of the first telescopic section such that it is substantially outside the visibility window of the upright.

8. An upright structure as claimed in claims 1 or 2 wherein the operative connection of said cylinder assembly to said telescopic section in relation to said one and other ends of the respective flexible lifting elements is such that at least approximately balanced lifting force moments act on the upright structure in the transverse plane of the upright.

9. An upright structure as claimed in claim 1 wherein the lift cylinder is connected to a member extending transversely of the upright which is operatively connected at its opposite ends to the spaced vertical rails of the telescopic section, said latter connections comprising lost motion means providing predetermined free-lift of the load carrier.

10. An upright structure as claimed in claim 9 wherein said second wheel element is supported from opposite side portions of said transverse member.

11. An upright structure as claimed in claims 1 or 2 wherein a member extends transversely of the upright on a bias to the upright between the vertical rails of said first telescopic section providing a relatively wide end portion at one side thereof and a relatively narrow end portion at the other side thereof.

12. An upright structure as claimed in claim 11 wherein said second wheel element is supported from opposite side portions of said transverse member.

13. An upright structure as claimed in claim 1 wherein the said other ends of the first and second flexible lifting elements are secured to said load carrier means at locations substantially equidistant and on opposite sides of the central vertical plane of the load carrier means.

14. An upright structure as claimed in claim 1 wherein said cylinder assembly is located intermediate central vertical plane of the load carrier means and the said one ends of said first and second flexible lifting elements such that the projected or transverse distance from the central vertical plane of the load carrier means to the axis of the cylinder assembly is approximately equal to one-quarter the sum of the projected or transverse distances from the central vertical plane of the load carrier means to the said one ends of said first and second flexible lifting elements.

15. An upright structure as claimed in claims 1 or 2 wherein a member extends transversely of the upright between the vertical rails of said first telescopic section, said second wheel element being supported from opposite side portions of said latter member.

16. An upright structure as claimed in claim 1 wherein said first flexible lifting element is reeved on a wheel comprising said first wheel element and said second flexible lifting element is reeved on a pair of transversely spaced wheels comprising said second wheel element mounted in substantial longitudinal rotating alignment, said cylinder assembly being mounted for extension intermediate the axes of rotation of said pair of wheels.

17. An upright structure as claimed in claim 16 wherein said intermediate location of said cylinder assembly is such that the sum of lifting force moments acting on the upright structure are at least approximately balanced in the transverse plane of the upright.

18. An upright structure as claimed in claim 16 wherein a member extends transversely of the upright on a bias between the vertical rails of said first telescopic section providing a rlatively wide end portion at one side and a relatively narrow end portion at the other side, said first wheel element and one wheel of said second wheel element being supported from the wide end portion of said transverse member and the other wheel of said second wheel element being supported from the narrow end portion of said transverse member.

19. An upright structure as claimed in claim 16 wherein a member extends transversely of the upright between the vertical rails of said first telescopic section, said second wheel element being supported from opposite side portions of said latter member.

20. An upright structure as claimed in claim 1 wherein the said other ends of the first and second flexible lifting elements are secured to said load carrier means at locations substantially equidistant and on opposite sides of the central vertical plane of the load carrier means.

21. An upright structure as claimed in claim 1 wherein said cylinder assembly is located intermediate the central vertical plane of the load carrier means and the said one ends of said first and second flexible lifting elements such that the projected or transverse distance from the central vertical plane of the load carrier means to the axis of the cylinder assembly is approximately equal to one-quarter the sum of the projected or transverse distances from the central vertical plane of the load carrier means to the said one ends of said first and second flexible lifting elements.

22. An upright structure as claimed in claim 21 wherein the location of said cylinder assembly is such that it projects at least partially into the longitudinal plane of the adjacent vertical rail on the said one side of the upright structure.

23. An upright structure as claimed in claim 2 wherein the said other ends of the first and second flexible lifting elements are secured to said second telescopic upright section at locations substantially equidistant and on opposite sides of the central vertical plane of the second telescopic section.

24. An upright structure as claimed in claim 2 wherein said cylinder assembly is located intermediate the central vertical plane of the second telescopic upright section and the said one ends of said first and second flexible lifting elements such that the projected or transverse distance from the central vertical plane of the second telescopic section to the axis of the cylinder assembly is approximately equal to one-quarter the sum of the projected or transverse distances from the central vertical plane of the second telescopic section to the said one ends of said first and second flexible lifting elements.

25. An upright structure as claimed in claims 1 2 or 24 wherein the location of said cylinder assembly is such that it projects at least partially into the longitudinal plane of the adjacent vertical rail on the said one side of the upright structure.

26. An upright structure as claimed in claim 2 wherein said first flexible lifting element is reeved on a wheel comprising said first wheel element and said second flexible lifting element is reeved on a pair of transversely spaced wheels comprising said second wheel element mounted in substantial longitudinal rotating alignment, said cylinder assembly being mounted for extension intermediate the axes of rotation of said pair of wheels.

27. An upright structure as claimed in claim 26 wherein the said other ends of the first and second flexible lifting elements are secured to said second telescopic section at locations substantially equidistant and on opposite sides of the central vertical plane of said second telescopic section.

28. An upright structure as claimed in claim 26 wherein said cylinder assembly is located intermediate the central vertical plane of the second telescopic section and the said one ends of said first and second flexible lifting elements such that the projected or transverse distance from the central vertical plane of said second telescopic section to the axis of the cylinder assembly is approximately equal to one-quarter the sum of the projected or transverse distances from the central vertical plane of said second telescopic section to the said one ends of said first and second flexible lifting elements.

29. An upright structure as claimed in claim 28 wherein the location of said cylinder assembly is such that it projects at least partially into the longitudinal plane of the adjacent vertical rail on the said one side of the upright structure.

* * * * *